US007179005B2

(12) United States Patent
Miyamoto et al.

(10) Patent No.: US 7,179,005 B2
(45) Date of Patent: Feb. 20, 2007

(54) INK FOLLOWER FOR WATER-BASED INK BALLPOINT PEN

(75) Inventors: Masaru Miyamoto, Yokohama (JP); Yoji Takeuchi, Yokohama (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 328 days.

(21) Appl. No.: 10/499,966

(22) PCT Filed: Dec. 27, 2002

(86) PCT No.: PCT/JP02/13825

§ 371 (c)(1),
(2), (4) Date: Jun. 24, 2004

(87) PCT Pub. No.: WO03/057507

PCT Pub. Date: Jul. 17, 2003

(65) Prior Publication Data

US 2005/0074273 A1 Apr. 7, 2005

(30) Foreign Application Priority Data

Dec. 28, 2001 (JP) ..... 2001-401795

(51) Int. Cl.
*B43K 7/08* (2006.01)

(52) U.S. Cl. ..... 401/142; 401/141

(58) Field of Classification Search ..... 401/141, 401/142

See application file for complete search history.

(56) References Cited

U.S. PATENT DOCUMENTS 4,671,691 A * 6/1987 Case et al. ..... 401/142

FOREIGN PATENT DOCUMENTS

| | | | |
|---|---|---|---|
| JP | 61-39580 | Y2 | 11/1986 |
| JP | 3016749 | B2 | 12/1998 |
| JP | 2000-301880 | A | 10/2000 |
| JP | 2001-353993 | A | 12/2001 |

OTHER PUBLICATIONS

English translation of International Preliminary Examination Report from corresponding PCT Application No. PCT/JP02/013825 filed Dec. 27, 2002.

* cited by examiner

*Primary Examiner*—David J. Walczak
(74) *Attorney, Agent, or Firm*—Buchanan, Ingersoll & Rooney PC

(57) ABSTRACT

An ink follower for a ballpoint pen using a water-based ink in which a value of the test for oil separation (60° C., 24 hours) according to JIS K 2220-5.7-1993 is 0.5 to 12% and which has a viscoelasticity predominant in an elastic response or a value of tan δ of 0.1 to 1.5 at a temperature of 25° C. and in the full frequency range of an angular frequency of 0.1 to 630 rad/sec, and it contains as a base oil, a non-water-soluble organic solvent having a viscosity of 5 Pas·sec or less at a temperature of 25° C. and a shearing speed of 1 to 400 $sec^{-1}$. Polybutene, mineral oil and silicone oil can be used as the base oil.

15 Claims, No Drawings

INK FOLLOWER FOR WATER-BASED INK BALLPOINT PEN

TECHNICAL FIELD

The present invention relates to an ink follower for a water-based ink ballpoint pen which is installed at a plug part in an ink reservoir of a ballpoint pen using a water-based ink (water-based ink ballpoint).

BACKGROUND ART

In general, a water-based ink ballpoint pen has such a low viscosity as 50 mPa·sec to 3 Pa·sec while a ballpoint pen using an oil-based ink having a similar structure has an ink viscosity of 3 Pa·sec to 20 Pa·sec, and therefore when the pen is left standing upward or horizontally, the ink leaks in a certain case. Further, the ink is likely to be scattered by slight impact to stain hands and cloths, and in order to prevent this, an ink follower is installed at a plug part in an ink reservoir of a water-based ink ballpoint pen.

A lot of ink followers which are increased in a viscosity by blending a base oil with a viscosity-controlling agent such as silica, metallic soap, a clay thickener and a thermoplastic elastomer has so far been applied as the above ink follower (for example, Japanese Patent No. 3016749).

However, if such ink followers are used particularly for a water-based ink ballpoint pen for bold lines consuming a large amount of inks, brought about are the problems that starving of the drawn lines is caused in writing because of difficulty in following of the ink and that a part of an ink follower adheres and remains on the inner wall of an ink reservoir in consuming the ink to result in causing a shortage in the ink follower in writing so that the ink flows backward or that an ink discharge amount in writing becomes instable due to an influence of the shortage in the ink follower. In the ballpoint pens of specifications other than those for bold lines, the same problems are brought about in a certain case when the writing speed is increased.

Such problems are considered to originate in a slower following speed of an ink follower than an ink-consuming speed.

Further, in an ink follower in which a viscosity value is controlled to a lower level in order to improve the above problems, brought about are the problems that the follower and the ink are scattered when impact is given to the pen body and that the ink follower leaks out from the ink reservoir when the pen is stored at a high temperature with the pen tip turned upward.

In light of the conventional problems described above, the present invention intends to solve them, and an object thereof is to provide an ink follower for a water-based ink ballpoint pen which has stable followability regardless of a pen specification, an ink discharge amount in writing and a writing speed and which does not cause back leaking of the ink originating in a shortage in the ink follower in writing and is not scattered by impact given to the pen body and which does not leak out from the ink reservoir in storing the pen at a high temperature. It is a matter of course that the above ink follower is an ink follower for a water-based ink ballpoint pen which can prevent the ink from volatilizing by shutting off the ink from the outside air (volatilization preventing property) and which can prevent the ink from leaking in writing with the pen turned upward.

DISCLOSURE OF THE INVENTION

Intensive researches repeated by the present inventors on the conventional problems described above have resulted in obtaining research results described in details in the following items (1) to (3) and successfully obtaining an ink follower meeting the object described above based on them, and thus the present invention has come to be completed.

(1) That is, it is inferred that in conventional ink followers for a water-based ink ballpoint pen, inferior following caused in the consumption of the water-based ink originates in, as described above, a slower following speed of the ink follower than an ink-consuming speed. This following speed depends on a viscosity of the ink follower to a large extent, and the ink follower having a higher viscosity value has a slower following speed and causes marked inferior following in the consumption of the ink. Also, in an ink follower in which a viscosity value is controlled to a lower level for a countermeasure thereof, brought about are the problems that the follower and the ink are scattered when impact is given to the pen body and that the pen follower leaks out from the ink reservoir when the pen is stored at a high temperature with the pen tip turned upward. Accordingly, it used to be very difficult to control both of followability and a performance in applying impact by the physical properties of the ink follower.

(2) Most of ink followers for a water-based ink ballpoint pen have a so-called grease form in which a viscosity is increased by blending a non-water-soluble organic solvent (base oil) with a viscoelasticity-providing agent.

In general, the above grease itself having such a quality that the base oil is deposited on its surface exerts, in many cases, an adverse effect on a product used, and therefore various trials for inhibiting oil separation as much as possible have been carried out in conventional greases. The same as described above applies to an ink follower for a water-based ink ballpoint pen, and use of an ink follower in which a lot of oil is deposited transfers a base oil component separated in an ink reservoir to an ink and results in deteriorating the appearance to be likely to reduce the product value.

Further, in a water-based ink ballpoint pen which is left standing with a pen tip turned upward, a base oil component separated is lighter than the ink in many cases, and therefore caused is the problem that the base oil component stays in the tip to cause inferior writing.

The present inventors have actually examined and investigated various ink followers to find that ink followers which are predominant in an elastic response and in which oil separates to such an extent that a base oil component does not move into an ink in a refill enhance pen quality.

This ink follower has a high following response in the consumption of the ink and is suited as well to a ballpoint pen for bold lines having a large discharge amount, and it is characterized by having a high clear drain property. The reason therefor is that a base oil component which is suitably separated has a relatively low viscosity, so that it has action to lower frictional resistance between the inner wall of an ink reservoir and the ink follower in consuming the ink (when the ink follower moves), and the response to following is considered to be raised.

If the ink follower is predominant in a viscosity, time difference is caused, as described above, between following of the ink follower and ink discharge. Accordingly, when a viscosity-predominant ink follower having a relatively high viscosity value is used, starving is caused in writing at a twice or higher speed than usual.

Also, an ink follower in which a viscosity is controlled to a lower level in order to enhance a response to following does not cause starving of drawn lines, but when impact is applied to the pen body, the ink follower is liable to be scattered, and the ink blows off from a rear end of the reservoir.

Further, the ink follower adheres and remains on the inner wall of a reservoir in consuming the ink and is gradually reduced in an amount thereof, and finally the ink leaks backward due to a shortage in the ink follower.

(3) On the other hand, the ink follower which is predominant in elasticity does not adhere and remain in an ink reservoir as compared with the ink follower which is predominant in a viscosity, but the satisfactory performance of following is not exerted in many cases depending on the kind and the proportion of a thickener which provides viscoelasticity.

However, the ink follower which is predominant in elasticity and in which a base oil component is slightly deposited is reduced in frictional resistance between the ink reservoir and the ink follower, and therefore the performance of following is enhanced further more regardless of the formation of the ink follower. Particularly a water-based ink ballpoint pen which uses an ink having a relatively low viscosity or is used for bold lines and which has a large discharge amount does not cause starving in drawing lines, and in writing at a twice or more speed by a ballpoint pen which is not for bold lines, drawn lines do not cause starving. Thus, the effect of response to following is very high. Further, it has both of an ink-sweeping property and drop impact resistance, which are originally the characteristics of the elasticity-predominant ink follower, and therefore the ink follower which is excellent in a quality balance can be obtained.

Accordingly, the present invention provides an ink follower meeting the object described above by having constitution described in the following items (1) to (4).

(1) An ink follower for a water-based ink ballpoint pen having a viscoelasticity which is predominant in an elastic response, wherein a value of the test for oil separation (60° C., 24 hours) according to JIS K 2220-5.7-1993 is 0.5 to 12%.

(2) An ink follower for a water-based ink ballpoint pen, wherein a value of tan δ of the ink follower at a temperature of 25° C. and in the full frequency range of an angular frequency of 0.1 to 630 rad/sec is 0.1 to 1.5, and a value of the test for oil separation (60° C., 24 hours) according to JIS K 2220-5.7-1993 is 0.5 to 12%.

(3) The ink follower for a water-based ink ballpoint pen as described in the above item (1) or (2), wherein a ratio of tan δ of the ink follower at 600 rad/sec and 0.06 rad/sec (600 rad/sec÷0.06 rad/sec) is 2 or less.

(4) The ink follower for a water-based ink ballpoint pen as described in any of the above items (1) to (3), comprising a base oil comprising a non-water-soluble organic solvent having a viscosity of 5 Pas·sec or less at a temperature of 25° C. and a shearing speed of 1 to 400 $sec^{-1}$.

(5) The ink follower for a water-based ink ballpoint pen as described in the above item (4), further comprising a thickener.

(6) The ink follower for a water-based ink ballpoint pen as described in the above item (4), wherein the base oil is polybutene having a number average molecular weight of 600 or more.

(7) The ink follower for a water-based ink ballpoint pen as described in the above item (4), wherein the base oil is a mineral oil.

(8) The ink follower for a water-based ink ballpoint pen as described in the above item (4), wherein the base oil is a silicone oil.

(9) The ink follower for a water-based ink ballpoint pen as described in the above item (5), wherein the thickener is a calcium salt of phosphoric acid ester.

(10) The ink follower for a water-based ink ballpoint pen as described in the above item (5), wherein the thickener is fine particle silica.

(11) The ink follower for a water-based ink ballpoint pen as described in the above item (5), wherein the thickener is at least one selected from a block copolymer of polystyrene-polyethylene/butylene rubber-polystyrene and a block copolymer of polystyrene-polyethylene/propylene rubber-polystyrene.

(12) The ink follower for a water-based ink ballpoint pen as described in the above item (5), wherein the thickener is a hydrogenated styrene-butadiene rubber.

(13) The ink follower for a water-based ink ballpoint pen as described in the above item (5), wherein the thickener is at least one selected from a block copolymer of styrene-ethylene butylene-olefin crystal and a block copolymer of olefin crystal-ethylene butylene-olefin crystal.

(14) The ink follower for a water-based ink ballpoint pen as described in the above item (5), wherein the thickener is acetoalkoxyaluminum dialkylate.

BEST MODE FOR CARRYING OUT THE INVENTION

The embodiment of the invention shall be explained below in details.

The ink follower of the present invention for a water-based ink ballpoint pen is characterized by having a viscoelasticity which is predominant in an elastic response, wherein a value of the test for oil separation (60° C., 24 hours) according to JIS K 2220-5.7-1993 is 0.5 to 12%. Further, a value of tan δ of the ink follower at a temperature of 25° C. and in the full frequency range of an angular frequency of 0.1 to 630 rad/sec is 0.1 to 1.5, and a value of the test for oil separation (60° C., 24 hours) according to JIS K 2220-5.7-1993 is 0.5 to 12%.

It is required that the ink follower in the present invention has a viscoelasticity which is predominant in an elastic response or a value of tan δ of the ink follower at a temperature of 25° C. and in the full frequency range of an angular frequency of 0.1 to 630 rad/sec is 0.1 to 1.5, and it is required that the base oil component is slightly deposited therefrom.

The deposition of the above base oil component can be measured by carrying out a test for oil separation, to be specific, the test for oil separation (60° C., 24 hours) according to JIS K 2220-5.7-1993, and the value thereof has to be controlled to a range of 0.5 to 12%, preferably 1.0 to 10%.

In the test for oil separation method prescribed in JIS K 2220-5.7-1993, a sample for measurement is filled into a metal-made screen conical filter prescribed in the JIS standard and left standing under the environment of 100° C. for 24 hours to measure an amount of oil deposited from the screen conical filter.

In the ink follower for a water-based ink ballpoint pen in the present invention, to be general, the method prescribed above can be adopted for an oil separating property (oil separation degree), but a part of the measuring conditions is preferably altered because of the following reason.

That is, most of viscoelasticity-controlling agents which can provide an elasticity are polymers such as thermoplastic elastomers, and if ink followers are prepared using them, the followers exhibit fluidity at about 100° C. to bring about reduction in a viscosity to a large extent in many cases. Accordingly, if the ink follower is left standing at 100° C., even the ink follower having a high performance for a ballpoint pen brings about, as described above, reduction in a viscosity to a large extent and leaks out to the outside of the screen conical filter, and therefore the reliability of the measurement itself is reduced to a large extent. Accordingly, considering the actual using environment of a ballpoint pen, a pen is hardly left standing at 100° C., and therefore it is not realistic to measure the deposition of oil at 100° C.

On the other hand, when a condition for measuring an oil separation degree is set to 60° C./24 h, large correlation between a measured value of oil separation and a pen performance has been observed in an elasticity-predominant ink follower. It has been confirmed that an ink follower which reveals an oil separating property falling in a specific range under the above temperature condition is excellent in both of an ink-sweeping property and drop impact resistance. Also, in a test with the accelerated passage of time, evaluation under storage at 50° C. to 60° C. is adopted in many cases, and therefore measurement at 60° C. is preferred from the viewpoint of evaluating a pen performance with the passage of time.

Accordingly, the test for oil separation in the present invention is carried out at 60° C./24 h in place of 100° C./24 h in the test for separation prescribed in JIS K 2220-5.7-1993.

In the present invention, if the oil separation degree in the test for oil separation (60° C./24 h) is less than 0.5%, frictional resistance between the ink reservoir and the ink follower is not reduced so much, and therefore a satisfactory performance of following in the pen is not revealed. On the other hand, if the oil separation degree exceeds 12.0%, the base oil component moves into an ink in the ink reservoir even in the elasticity-predominant ink follower to bring about the deteriorated appearance and inferior writing in a certain case, and therefore it is not preferred.

It is required that the ink follower of the present invention has an oil separation degree of 0.5 to 12%, as described above, in the test for oil separation (60° C./24 h) and has a viscoelasticity which is predominant in an elastic response or a value of the tan δ at a temperature of 25° C. and in the full frequency range of an angular frequency of 0.1 to 630 rad/sec is 0.1 to 1.5.

In general, tan δ can be used as an index for an intensity of viscoelasticity of an ink follower. An ink follower in which tan δ is less than 1.5 in a low frequency area and more than 1.5 in a high frequency area is introduced in, for example, U.S. Pat. No. 4,671,691. In this case, tan δ is a value meaning loss modulus/storage modulus. The large value (tan δ>1) means that the follower has high fluidity or is a viscous material, and the small value (tan δ<1) means that the follower is close to a solid material (or an elastic material).

If a value of the tan δ at a temperature of 25° C. and in the full frequency range of an angular frequency of 0.1 to 630 rad/sec is 0.1 to 1.5 in the ink follower of the present invention for a water-based ballpoint pen, it is provided with a viscoelasticity which is predominant in an-elastic response.

This value of the tan δ at a temperature of 25° C. and in the full frequency range of an angular frequency of 0.1 to 630 rad/sec is preferably 0.3 to 1.0, more preferably 0.5 to 1.0. Further, a ratio of the tan δ at 600 rad/sec and 0.06 rad/sec (600 rad/sec÷0.06 rad/sec) is preferably 2 or less.

If the tan δ exceeds 1.5 in a specific frequency range between 0.1 to 630 rad/sec, a ballpoint pen for bold lines which uses the above ink follower and pseudo-plastic water-based ink and which consumes much ink brings about in a certain case, the problems that starving in the drawn lines is caused in writing due to difficulty in following the ink or a part of the ink follower adheres and remains on the inner wall of the ink reservoir in consuming the ink, which results in a shortage in the ink follower in writing so that the ink leaks backward and an ink discharge amount becomes instable. The same problems as described above are caused as well by a ballpoint pen other than a pen for bold lines if a writing speed is raised.

If the tan δ exceeds 1.5 in all frequency ranges, brought about are the problems that the response to following of the ink follower in the ink reservoir is inferior in consumption of the ink and that the ink follower is liable to be scattered when impact is applied to the pen body.

In contrast with this, if the tan δ is less than 0.1 in a specific frequency range between 0.1 to 630 rad/sec or all frequency ranges, elasticity of the ink follower is considerably strengthened, so that filling it into an ink reservoir becomes difficult to lose the practicality.

On the other hand, if a ratio of tan δ of an ink follower at 600 rad/sec and 0.06 rad/sec (600 rad/sec÷0.06 rad/sec) exceeds 2, the response to following of the ink follower in consumption of the ink changes when writing is carried out at both of a low speed and a high speed by means of a ballpoint pen which uses a pseudo-plastic ink and the above ink follower, and the following problems are caused in a certain case.

That is, in writing at a low speed, the response to following of the ink follower is relatively good and therefore defects such as reduction in the drawn line drying property attributable to an excess of an ink discharge in writing and the generation of blobbing are likely to be brought about. In writing at a high speed, the physical properties of the ink follower are close to those of a viscous material, and the response to following is inferior, so that starving in the drawn lines is caused in a certain case due to difficulty in following the ink.

Accordingly, the preferred ideal ink follower for a water-based ballpoint pen has low tan δ in which the response to following is relatively good, does not change in behavior to following when a writing speed is varied and has relatively fixed tan δ in almost all frequencies.

The base oil used for the ink follower in the present invention preferably contains a non-water-soluble organic solvent having a viscosity of 5 Pa·sec or less at a shearing speed of 1 to 400 $sec^{-1}$ at 25° C. It is naturally required of the base oil used for the ink follower in the present invention that it is insoluble or scarcely soluble in water, and the most important factor required of the base oil in order to obtain an effect for preventing the ink from leaking from the rear end due to the back leaking, which is the characteristic of the present invention, is a viscosity value thereof.

The solvent used for the base oil is desirably a solvent having a viscosity of 5 Pa·sec or less, preferably 2 Pa·sec or less and more preferably 0.5 to 1.5 Pa·sec at 25° C. wherein the viscosity may be measured at any shearing speed as long as it falls in a range of 1 to 400 $sec^{-1}$, because it shows an approximate Newtonian viscosity (viscosity is constant regardless of a shearing speed).

The ink follower containing the base oil having a viscosity of exceeding 5 Pa·sec has a high viscosity in a high shearing area and therefore is inferior in a filling property into an ink reservoir, and writing by means of a water-based ink ballpoint pen using the above ink follower brings about the problem that starving is liable to be caused due to the reduced ink followability.

When mixing several kinds of base oils, they are preferably controlled and used so that the viscosity value falls in the range described above. The specific solvent for the base oil includes polybutene having a number average molecular weight of about 600 or more, mineral oil and silicone oil.

A solvent which is volatilized by several % by weight in 2 to 3 years such as polybutene having a number average molecular weight of less than 600 is not preferred considering the performance of the ballpoint pen with the passage of time. In respect to the standard therefor, preferred is a single or mixed base oil which shows a volatilization loss of about 1% by weight or less after 10 days when it is put in an amount of about 10 g in a Petri dish having a diameter of about 40 mm in the environment of 50° C. and a humidity of 30% and then left standing under open environment. Further, a base oil which increases in a viscosity by oxidation is not preferred.

The commercial products of polybutene which can preferably be used include, for example, Nissan Polybutene 200N, Polybutene 30N (manufactured by NOF Corporation), Polybutene HV-15 (manufactured by Nippon Petrochemicals Co., Ltd.) and 35R (manufactured by Idemitsu Kosan Co., Ltd.). Also, the commercial products of mineral oil which can preferably be used include, for example, Diana Process Oil MC-32S and MC-W90 (manufactured by Idemitsu Kosan Co., Ltd.). Further, the commercial products of silicone oil which can preferably be used include, for example, TSF451 series, TSF456 series and TSF458 series (manufactured by Toshiba Silicone Co., Ltd.).

A substance which can provide a viscoelasticity is used for the ink follower in the present invention, and all materials out of thickeners can be used as long as they have a property which can provide elasticity. The specific examples thereof include calcium salts of phosphoric acid esters, fine particle silica, a block copolymer of polystyrene-polyethylene/butylene rubber-polystyrene, a block copolymer of polystyrene-polyethylene/propylene rubber-polystyrene, hydrogenated styrene-butadiene rubber, a block copolymer of styrene-ethylene butylene-olefin crystal, a block copolymer of olefin crystal-ethylene butylene-olefin crystal and acetoalkoxyaluminum dialkylate. They can be used alone or in combination of two or more kinds thereof.

The preferred commercial products of calcium salts of phosphoric acid esters include Crodax DP-301LA (manufactured by Croda Japan K. K.).

Fine particle silica which can be used includes hydrophilic fine particle silica and hydrophobic fine particle silica. The preferred commercial products of hydrophilic fine particle silica include AEROSIL-300 and AEROSIL-380 (manufactured by Nippon Aerosil Co., Ltd.), and the preferred commercial products of hydrophobic fine particle silica include AEROSIL-974D and AEROSIL-972 (manufactured by Nippon Aerosil Co., Ltd.).

The preferred commercial products of the block copolymer of polystyrene-polyethylene/butylene rubber-polystyrene include Claytone GFG-1901X, Claytone GG-1650 (manufactured by Shell Chemicals Japan Co., Ltd.), Septon 8007 and Septon 8004 (manufactured by Kuraray Co., Ltd.). Further, the preferred commercial products of the block copolymer of polystyrene-polyethylene/propylene rubber-polystyrene include Claytone GG-1730 (manufactured by Shell Chemicals Japan Co., Ltd.), Septon 2006 and Septon 2063 (all manufactured by Kuraray Co., Ltd.).

The preferred commercial products of the hydrogenated styrene-butadiene rubber include Dynaron 1320P, Dynaron 1321P (manufactured by JSR Corporation), Tuftec H1041 and Tuftec H 1141 (manufactured by Asahi Kasei Corporation).

The preferred commercial products of the block copolymer of styrene-ethylene butylene-olefin crystal include Dynaron 4600P (manufactured by JSR Corporation), and the preferred commercial products of the block copolymer of olefin crystal-ethylene butylene-olefin crystal include Dynaron 6200P (manufactured by JSR Corporation).

The preferred commercial products of acetoalkoxyaluminum dialkylate include Plenact AL-M (manufactured by Ajinomoto Fine-Techno Co., Inc.).

The above thickeners are blended for the purpose of controlling a viscoelasticity of the ink follower so that it is predominant in elasticity. An effect of providing elasticity or a structural viscoelasticity is exerted by blending the above thickeners in a suited amount, and the tan δ can be controlled to 1.5 or less by controlling the blending amount.

In addition to the components described above, thickening aids (clay thickeners, metallic soaps and the like), surfactants and antioxidants can be blended, if necessary. However, some compounds among the thickening aids, the surfactants and the antioxidants enhance the value of tan δ, and therefore if they are blended in a larger amount than required, the tan δ is likely to exceed 1.5 even if the thickener is blended in a prescribed amount. Accordingly, attentions have to be paid when blending them.

Capable of being used as a production method for the ink follower for a water-based ballpoint pen of the present invention is, for example, a method in which all ink follower components such as a base oil, a surfactant and the like are preliminarily mixed at room temperature and then mixed by means of a disperser such as a roll mill and a kneader when using an inorganic thickener such as fine particle silica. When adding a polymer which is difficult to be dissolved and dispersed at room temperature, stirring under heating or mixing under heating can be carried out, if necessary.

Further, the ink follower produced is kneaded again by means of a disperser such as a roll mill and a kneader and heated, whereby the tan δ at each frequency of 0.1 to 630 rad/sec can be controlled to 0.1 to 1.5.

To more specifically explain, when a tan δ of the ink follower produced using the polymer base thickener described above is lower than expected, it is kneaded again by means of a disperser such as a roll mill and a kneader to break the thickening structure, whereby the tan δ can be raised. In contrast with this, when the tan δ is higher than expected, the ink follower is heated again to not lower than a glass transition point of the thickener (polymer), whereby the thickening mechanism of the polymer is improved to strengthen the thickening structure so that the tan δ can be reduced.

When a tan δ of the ink follower produced using the inorganic thickener is lower than expected, the ink follower can be diluted with the base oil to control a viscosity.

Further, when the tan δ value is higher than expected, the ink follower is redispersed by means of a stirrer such as a kneader and others to reconstruct a thickening structure, whereby the tan δ can be reduced.

The ink follower for a water-based ballpoint pen of the present invention is improved in a pen performance such as followability by suitably depositing the base oil component. The degree of the deposition of the base oil component (oil separation degree) can be controlled by adopting the following controlling methods (1) to (6). These controlling methods (1) to (6) can be used alone or in suited combination of two or more kinds thereof.

A method for elevating the oil separation degree includes the respective methods such as (1) blending the base oil in a little excess to control a concentration of the thickener to a lower level, (2) carrying out stirring under heating at as low temperature as possible, when using the polymer base thickener, (3) reducing the stirring and kneading ability of a roll mill or a kneader to make the dispersion of the thickener a little uneven and (4) leaving the ink follower produced standing at a relatively high temperature (preferably 30 to 60° C.) for several days.

Further, a method for reducing the oil separation degree includes the respective methods such as (5) raising a blending amount of the thickener to strengthen a thickening structure and to enhance the ability of holding the base oil and (6) elevating the stirring and kneading ability of a roll mill and a kneader to uniformize the dispersion of the thickener.

The ink follower for a water-based ballpoint pen of the present invention thus constituted is provided with basic performances such as shutting off the ink from the outside air to prevent the ink from volatilizing (volatilization preventing property) and preventing the ink from leaking in writing with the pen turned upward by having viscoelasticity which is predominant in an elastic response and controlling a value of the test for oil separation (60° C., 24 hours) according to JIS K 2220-5.7- 1993 to 0.5 to 12% or by controlling a temperature of 25° C. and in the full frequency range of an angular frequency of 0.1 to 630 rad/sec to 0.1 to 1.5 and controlling a value of the test for oil separation (60° C., 24 hours) according to JIS K 2220-5.7-1993 to 0.5 to 12%. Further, it is provided with excellent performances such as having stable followability regardless of the specifications of the pen, the ink discharge amount in writing and the writing speed, causing no back leaking originating in a shortage in the ink follower in writing, no scattering of the ink follower even by impact applied to the pen body and no leaking of the ink follower from the ink reservoir even in storing the pen at a high temperature.

In addition, the excellent performances of the ink follower described above can further be improved by controlling a ratio of tan δ at 600 rad/sec and 0.06 rad/sec (600 rad/sec÷0.06 rad/sec) to 2 or less and containing a base oil comprising a non-water-soluble organic solvent having a viscosity of 5 Pas·sec or less at a temperature of 25° C. and a shearing speed of 1 to 400 $sec^{-1}$.

EXAMPLES

Next, the present invention shall more specifically be explained with reference to examples and comparative examples, but the present invention shall by no means be restricted by the following examples.

Examples 1 to 6 and Comparative Examples 1 to 5

Water-based inks (Inks (1) to (3), the total amounts each are 100% by weight) for a ballpoint pen used in the respective examples and comparative examples were prepared according to blending formations shown below.

| Preparation of Ink (1) | |
|---|---|
| Dye: Water Black R455 (manufactured by Orient Chemical Ind., Ltd.) | 7.0% by weight |
| Dye: Water Yellow 6C (manufactured by Orient Chemical Ind., Ltd.) | 1.0% by weight |
| Liquid medium: propylene glycol | 20.0% by weight |
| Thickener: xanthan gum (KELZAN HP) (manufactured by Sansho Co., Ltd.) | 0.2% by weight |
| Surfactant: potassium oleate | 0.5% by weight |
| Preservative: sodium omadine | 0.1% by weight |
| Rust preventive: benzotriazole | 0.1% by weight |
| Ion-exchanged water | balance |

The above mixture was stirred and then filtered to obtain a water-based black ink for a ballpoint pen.

| Preparation of Ink (2) | |
|---|---|
| Pigment: carbon black (Printex 25) (manufactured by Degussa AG.) | 7.0% by weight |
| Dispersant: polyvinylpyrrolidone (PVP-K30) (manufactured by GAF Co., Ltd.) | 3.5% by weight |
| Liquid medium: glycerin | 10.0% by weight |
| Thickener: cross-linking type polyacrylic acid (Hiviswako #105) (manufactured by Wako Pure Chemical Industries, Ltd.) | 0.4% by weight |
| Surfactant: potassium ricinoleate | 0.5% by weight |
| pH controlling agent: triethanolamine | 1.0% by weight |
| Preservative: 1,2-benzoisothiazoline-3-one | 0.1% by weight |
| Rust preventive: benzotriazole | 0.1% by weight |
| Ion-exchanged water | balance |

The above mixture was stirred and then filtered to obtain a water-based black ink for a ballpoint pen.

| Preparation of Ink (3) | |
|---|---|
| Pigment: phthalocyanine blue (Chromofine Blue 4965, manufactured by Dainichiseika Color & Chemicals MFG. Co., Ltd.) | 1.5% by weight |
| Pigment: titanium oxide (TITONE R-11P, manufactured by Sakai Chemical Industry. Co., Ltd.) | 20.0% by weight |
| Dispersant: styrene maleic acid resin ammonium salt | 2.5% by weight |
| Liquid medium: ethylene glycol | 5.0% by weight |
| Thickener: xanthan gum (KELZAN HP) (manufactured by Sansho Co., Ltd.) | 0.2% by weight |
| Surfactant: potash soap | 0.5% by weight |
| pH controlling agent: aminomethylpropanol | 0.3% by weight |
| Preservative: sodium omadine | 0.1% by weight |
| Rust preventive: saponins | 0.1% by weight |
| Ion-exchanged water | balance |

The above mixture was stirred and then filtered to obtain a water-based blue ink for a ballpoint pen.

Ink followers used in the respective examples and comparative examples were prepared according to formations shown in the following Table 1 and Table 2 and preparing methods A to D shown below.

Ink Follower Preparing Methods A to D

Ink Follower Preparing Method: A Method:

A base oil and a thickener (and additives) were blended and stirred at a high speed at room temperature for about 120 minutes by means of a mixer. Then, the mixture was subjected once to roll treatment and defoamed in vacuum to obtain an ink follower.

Ink Follower Preparing Method: B Method:

A base oil and a thickener (and additives) were blended and stirred at a high speed at 150° C. to 180° C. for about 120 minutes by means of a mixer and cooled down to room temperature. Then, the mixture was subjected once to roll treatment to obtain an ink follower.

Ink Follower Preparing Method: C Method:

A base oil and a thickener (and additives) were blended and stirred at a high speed at 160° C. to 170° C. for about 180 minutes by means of a mixer and cooled down to room temperature. Then, the mixture was kneaded for 60 minutes by means of a kneader to obtain an ink follower.

Ink Follower Preparing Method: D Method:

A base oil and a thickener (and additives) were blended and stirred at a low speed at 100° C. to 120° C. for about 120 minutes by means of a mixer and cooled down to room temperature to obtain an ink follower.

An oil-separating property and a tan δ of the oil followers obtained by the respective methods described above were measured by the following methods.

According to the respective specifications shown in the following Table 1 and Table 2, 0.1 g of the above ink followers each and 1.0 g of the inks (1) to (3) described above each were filled into an ink reservoir (refill tube) of a ballpoint pen body having a ball diameter of 1.0 mm manufactured by Mitsubishi Pencil Co., Ltd., and the respective pen bodies were subjected to the evaluation tests of the respective items of (1) followability in writing at a high speed, (2) scattering of the ink follower caused by drop impact, (3) adherence of the ink follower onto the tube in consuming the ink, (4) discharge stability of the ink and (5) inversion and back leaking of the ink follower by the following methods.

The results thereof are shown in the following Table 1 and Table 2.

Measuring Method of Oil Separation Degree (According to JIS K 2220-5.7-1993)

A measuring apparatus having the following constitution was used.

Screen conical filter: a conical part is a nickel screen having a nominal dimension of 250 μm prescribed in JIS Z 8801-1993, and a nickel wire having a diameter of about 0.8 mm is brazed in the periphery of the upper part and a nickel wire hanger having the same diameter is installed.

Beaker: prescribed in JIS K 2039-1993.

Cover: made of brass having a thickness of about 1 mm, and a hook made of brass having a diameter of about 1.5 mm is brazed on an inner face of almost the center thereof.

Gasket: having a diameter of the same dimension as an inner diameter of the cover and made of synthetic rubber having a thickness of about 1.5 mm, wherein a hole of about 20 mm is provided in the center part.

| Measuring environment | |
|---|---|
| Measuring temperature: | 60 ± 0.55° C. |
| Time for leaving standing: | 24 hours |

Measuring Method

The screen conical filter was filled with about 10 g of a sample and hung on the hook of the cover. This was stored in the beaker and put in a constant temperature bath for prescribed time. The beaker was taken out from the constant temperature bath and left cooling down to room temperature, and then oil adhered on the cone was transferred into the beaker to determine a mass of the separated oil in the beaker according to the following calculating equation:

Oil Separation Degree Calculating Equation:

$$A=C/B\times 100$$

(wherein A: oil separation degree (%), B: mass (g) of the sample and C: mass (g) of the separated oil)

Measuring Method of Tan δ Value

Measuring Apparatus

Dynamic Spectrometer RDS-II (Manufactured by Rheometric Scientific Co., Ltd.)

| Measuring conditions (frequency dependency) | |
|---|---|
| Geometry: | parallel plate 50 mmΦ dynamic measurement |
| Sweep type: | Frequency sweep |
| Frequency range: | 0.06 to 650 rad/sec |
| Measuring interval: | 5 points/decade |
| Deformation: | 100% |
| Measuring temperature: | 25° C. |
| Environment: | in nitrogen flow |

(1) Evaluation Method of Followability in Writing at a High Speed

Writing was carried out on a writing paper meeting an ISO standard at a twice speed and a normal speed with a free hand by means of the respective pen bodies to evaluate the respective written lines according to the following evaluation criteria.

Evaluation Criteria:

◎: no starving is observed in writing at both of a twice speed and a normal speed, and writable smoothly and stably o: slight skip is caused at a twice speed, and writable at a normal speed Δ: apparent skip is caused at a twice speed, and writable at a normal speed ×: ink does not follow even when normally written, and skip is caused (2) Evaluation Method of Scattering of the Ink Follower by Drop Impact The pen tip of each pen body was turned upward and dropped once from 1.5 m high on to a cedar board having a thickness of 2 cm, and the pen body after dropped was visually observed to evaluate the degree of scattering of the ink follower to the outside of the ink reservoir according to the following evaluation criteria. Evaluation criteria:

o: scattering of the ink follower is not observed, and an interface between the ink and the ink follower is clear Δ: scattering of the ink follower is not observed, but an interface between the ink and the ink follower is a little disordered as compared with before the pen body is dropped ×: scattering of the ink follower is apparently observed, and the ink leaks backward to the outside of the tube (3) Evaluation Method of Adherence of the Ink Follower onto the Tube in Consuming the Ink Spiral writing was carried out on a writing paper meeting the ISO standard under the following conditions by means of a writing test machine until the ink was exhausted, and the refill tube after writing was visually observed to evaluate the adherence of the ink follower onto the inner wall of the tube according to the following evaluation criteria.

Evaluation Criteria:

◎: adherence of the ink follower onto the inner wall of the tube is scarcely observed o: adherence of the ink follower onto the inner wall of the tube is slightly observed Δ: adherence of the ink follower onto the inner wall of the tube is apparently observed ×: all ink follower is adhered onto the inner wall of the tube, and the ink follower falls into shortage in writing (4) Evaluation Method of Discharge Stability of the Ink Spiral writing was carried out on a writing paper meeting the ISO standard under the following conditions by means of a writing test machine until the ink was exhausted, and the change of the ink discharge amount and the state of the drawn lines in writing every 100 m were evaluated according to the following evaluation criteria. Writing conditions: writing speed: 4.5 m/minute, writing angle: 60 ° and writing load: 100 g Evaluation Criteria:

◎: discharge amount is stable, and starving and density unevenness are not caused until the ink is exhausted o: discharge amount is slightly scattered, but starving and density unevenness are not caused until the ink is exhausted Δ: discharge amount is a little disordered, and starving and density unevenness are slightly observed ×: discharge amount is scattered to a large extent, and starving and density unevenness are apparently observed (5) Evaluation Method of Inversion and Back Leaking of the Ink Follower The respective pen bodies were left standing under the conditions of 50° C. and a humidity of 65% with the pen tip (cap side) turned upward, and after taken out, the refill was visually observed to evaluate mixing (called inversion) of the base oil component contained in the ink follower into the ink and the presence of leaking of the oil to the outside of the refill according to the following evaluation criteria.

Evaluation Criteria:

o: inversion of the oil into the ink or leaking of the oil to the outside of the refill is not observed ×: inversion of the oil into the ink or leaking of the oil to the outside of the refill is observed

TABLE 1

| | | Example | | | | | |
|---|---|---|---|---|---|---|---|
| | | 1 | 2 | 3 | 4 | 5 | 6 |
| Kind of ink used | | Ink (1) | Ink (2) | Ink (3) | Ink (1) | Ink (2) | Ink (3) |
| Base oil | Polybutene average molecular weight 1350*1 | | | 95.5 | | 91.5 | 60.0 |
| | Mineral oil average molecular weight 740*2 | 95.5 | 97.0 | | 93.0 | | 36.0 |
| | Polybutene average molecular weight 580*3 | | | | | | |
| Thickener | Phosphoric acid ester calcium salt*4 | | | | | | |
| | Fine particle silica*5 | | | | | 5.0 | |
| | Polystyrene-polyethylene/butylene rubber -polystyrene block copolymer*6 | | 2.5 | | | | 2.0 |
| | Polystyrene-polyethylene/propylene rubber -polystyrene block copolymer*7 | | | 4.5 | | | 2.0 |
| | Hydrogenated styrene-butadiene rubber*8 | 5.0 | | | | | |
| | Styrene-ethylene butylene-olefin crystal block copolymer*9 | | | | 7.0 | | |
| | Olefin crystal-ethylene butylene-olefin crystal block copolymer*10 | | | | | 3.0 | |
| | Polystyrene-butylene rubber-polystyrene block copolymer*11 | | | | | | |
| | Polystyrene-isoprene rubber-polystyrene block copolymer*12 | | | | | | |
| | Dimethyldioctadecyl ammonium bentonite*13 | | | | | | |
| Additive: fluorine base surfactant*14 | | | 0.5 | | | 0.5 | |
| Preparing method of ink follower | | D | D | B | B | C | C |
| Oil separation degree (60° C./24 h) | | 0.8 | 10.3 | 3.5 | 0.6 | 1.0 | 0.9 |
| Ink follower physical property | tan δ value 0.06 rad/sec | 0.71 | 0.92 | 0.88 | 0.52 | 1.13 | 0.40 |
| | tan δ value 0.10 rad/sec | 0.71 | 1.01 | 0.90 | 0.55 | 0.11 | 0.41 |
| | tan δ value 0.25 rad/sec | 0.65 | 1.17 | 0.88 | 0.60 | 1.11 | 0.41 |
| | tan δ value 0.63 rad/sec | 0.64 | 1.14 | 0.92 | 0.58 | 1.10 | 0.42 |
| | tan δ value 1.0 rad/sec | 0.68 | 0.87 | 1.05 | 0.57 | 1.00 | 0.44 |
| | tan δ value 4.0 rad/sec | 0.83 | 0.73 | 1.12 | 0.55 | 0.98 | 0.43 |
| | tan δ value 6.3 rad/sec | 0.81 | 0.78 | 1.23 | 0.55 | 0.96 | 0.41 |
| | tan δ value 10 rad/sec | 0.77 | 0.64 | 1.02 | 0.54 | 0.91 | 0.42 |
| | tan δ value 40 rad/sec | 0.62 | 0.66 | 0.89 | 0.55 | 0.86 | 0.43 |
| | tan δ value 63 rad/sec | 0.69 | 0.67 | 0.88 | 0.54 | 0.88 | 0.44 |
| | tan δ value 100 rad/sec | 0.72 | 0.68 | 0.90 | 0.58 | 0.88 | 0.46 |
| | tan δ value 400 rad/sec | 0.87 | 0.78 | 0.93 | 0.67 | 0.97 | 0.47 |
| | tan δ value 600 rad/sec | 0.68 | 0.83 | 0.95 | 0.75 | 1.18 | 0.62 |
| | tan δ value 630 rad/sec | 0.69 | 0.90 | 0.88 | 0.75 | 1.25 | 0.63 |

TABLE 1-continued

| | | Example | | | | | |
|---|---|---|---|---|---|---|---|
| | | 1 | 2 | 3 | 4 | 5 | 6 |
| tan δ ratio (1) (600 rad/sec + 0.06 rad/sec) | | 0.96 | 0.90 | 1.08 | 1.44 | 1.04 | 1.55 |
| Evaluation of pen | (1) followability in writing at a high speed | ◎ | ◎ | ◎ | ○ | ◎ | ◎ |
| | (2) scattering of the ink follower caused by drop impact | ○ | ○ | ○ | ○ | ○ | ○ |
| | (3) adherence of the ink follower onto the tube in consuming the ink | ◎ | ◎ | ◎ | ◎ | ◎ | ◎ |
| | (4) discharge stability of the ink | ◎ | ◎ | ◎ | ◎ | ◎ | ◎ |
| | (5) inversion and back leaking of the ink follower | ○ | ○ | ○ | ○ | ○ | ○ |

TABLE 2

| | | Comparative Example | | | | |
|---|---|---|---|---|---|---|
| | | 1 | 2 | 3 | 4 | 5 |
| Kind of ink used | | Ink (3) | Ink (2) | Ink (2) | Ink (3) | Ink (2) |
| Base oil | Polybutene average molecular weight 1350*1 | | | | 50.0 | 89.0 |
| | Mineral oil average molecular weight 740*2 | | | 99.2 | 19.5 | |
| | Polybutene average molecular weight 580*3 | 97.5 | 99.0 | | | |
| Thickener | Phosphoric acid ester calcium salt*4 | | | 0.3 | | |
| | Fine particle silica*5 | 2.5 | | | | 4.0 |
| | Polystyrene-polyethylene/butylene rubber -polystyrene block copolymer*6 | | 2.0 | | | |
| | Polystyrene-polyethylene/propylene rubber -polystyrene block copolymer*7 | | 0.3 | | | 4.0 |
| | Hydrogenated styrene-butadiene rubber*8 | | | 0.5 | | |
| | Styrene-ethylene butylene-olefin crystal block copolymer*9 | | | | | |
| | Olefin crystal-ethylene butylene-olefin crystal block copolymer*10 | | | | | |
| | Polystyrene-butylene rubber-polystyrene block copolymer*11 | | | | 27.0 | |
| | Polystyrene-isoprene rubber-polystyrene block copolymer*12 | | | | 3.0 | |
| | Dimethyldioctadecyl ammonium bentonite*13 | | | | | 3.0 |
| Additive: fluorine base surfactant*14 | | | 0.5 | | 0.5 | |
| Preparing method of ink follower | | A | B | B | C | C |
| Oil separation degree (60° C./24 h) | | 0.1 | 15.2 | 29.4 | <0.1 | 0.5 |
| Ink follower physical property | tan δ value 0.06 rad/sec | 22.52 | 0.92 | 1.43 | 0.08 | 1.58 |
| | tan δ value 0.10 rad/sec | 22.52 | 0.92 | 1.44 | 0.09 | 1.59 |
| | tan δ value 0.25 rad/sec | 22.54 | 0.93 | 1.45 | 0.09 | 1.58 |
| | tan δ value 0.63 rad/sec | 24.92 | 1.02 | 1.32 | 0.09 | 1.79 |
| | tan δ value 1.0 rad/sec | 27.16 | 1.12 | 1.26 | 0.12 | 1.96 |
| | tan δ value 4.0 rad/sec | 31.85 | 1.20 | 1.20 | 0.13 | 2.43 |
| | tan δ value 6.3 rad/sec | 28.49 | 1.25 | 1.14 | 0.24 | 2.77 |
| | tan δ value 10 rad/sec | 25.03 | 1.35 | 1.08 | 0.39 | 3.16 |
| | tan δ value 40 rad/sec | 23.99 | 1.35 | 0.93 | 0.41 | 3.42 |
| | tan δ value 63 rad/sec | 22.14 | 1.38 | 0.89 | 0.48 | 3.70 |
| | tan δ value 100 rad/sec | 30.39 | 1.42 | 0.95 | 0.53 | 3.89 |
| | tan δ value 400 rad/sec | 31.43 | 1.31 | 1.53 | 0.62 | 4.15 |
| | tan δ value 600 rad/sec | 32.64 | 1.03 | 2.46 | 0.74 | 4.47 |
| | tan δ value 630 rad/sec | 32.55 | 1.20 | 2.47 | 0.89 | 4.47 |
| tan δ ratio (1) (600 rad/sec + 0.06 rad/sec) | | 1.45 | 1.12 | 1.72 | 9.25 | 2.83 |
| Evaluation of pen | (1) followability in writing at a high speed | ◎ | ◎ | ◎ | X | ◎ |
| | (2) scattering of the ink follower caused by drop impact | Δ | X | X | ○ | Δ |
| | (3) adherence of the ink follower onto the tube in consuming the ink | X | ◎ | Δ | ◎ | X |
| | (4) discharge stability of the ink | X | ◎ | ◎ | ○ | ◎ |
| | (5) inversion and back leaking of the ink follower | ○ | X | X | ○ | ○ |

The following compounds were used for *1 to *14 in Table 1 and Table 2 described above.

*1: Polybutene 30N (manufactured by NOF Corporation)
*2: Diana Process Oil PW-380 (manufactured by Idemitsu Kosan Co., Ltd.)
*3: Nissan Polybutene 015N (manufactured by NOF Corporation)
*4: Crodax DP-30 (manufactured by Croda Japan K. K.)
*5: Aerosil-974 (manufactured by Nippon Aerosil Co., Ltd.)
*6: Septon 8007 (manufactured by Kuraray Co., Ltd.)
*7: Septon 2063 (manufactured by Kuraray Co., Ltd.)
*8: Tuftec 1141 (manufactured by Asahi Kasei Corporation)
*9: Dynaron 4600P (manufactured by JSR Corporation)
*10: Dynaron 6200P (manufactured by JSR Corporation)
*11: Asaprene T-431 (manufactured by Asahi Kasei Corporation)
*12: Solprene 418 (manufactured by Asahi Kasei Corporation)
*13: Bentone 34 (manufactured by Wilbur Ellis Co., Ltd.)
*14: Eftop EF-801(manufactured by Mitsubishi Materials Corporation)

As apparent from the results shown in Table 1 and Table 2 described above, it has become clear that in Examples 1 to 6 falling in the scope of the present invention as compared with in Comparative Examples 1 to 5 falling outside the scope of the present invention, the followability in writing at a high speed is excellent and the discharge stability of the ink is excellent as well without causing scattering of the ink follower by drop impact and adherence of the ink follower onto the tube in consuming the ink and that all performances can be satisfied without causing inversion and back leaking of the ink follower.

INDUSTRIAL APPLICABILITY

According to the present invention, provided is an ink follower for a water-based ink ballpoint pen which has stable followability regardless of a pen specification, an ink discharge amount in writing and a writing speed and does not cause back leaking of the ink originating in a shortage in the ink follower in writing and which is not scattered by impact given to the pen body and does not leak out from the ink reservoir in storing the pen at a high temperature. It can suitably be applied to a ballpoint pen using a water-based ink.

What is claimed is:

1. An ink follower for a water-based ink ballpoint pen having a viscoelasticity which is predominant in an elastic response, wherein a value of the test for oil separation (60° C., 24 hours) according to JIS K 2220-5.7-1993 is 0.5 to 12 %.

2. An ink follower for a water-based ink ballpoint pen, wherein a value of tan δ of the ink follower at a temperature of 25° C. and in the full frequency range of an angular frequency of 0.1 to 630 rad/sec is 0.1 to 1.5, and a value of the test for oil separation (60° C., 24 hours) according to JIS K 2220-5.7-1993 is 0.5 to 12 %.

3. The ink follower for a water-based ink ballpoint pen as described in claim 2, wherein a ratio of tan δ of the ink follower at 600 rad/sec and 0.06 rad/sec (600 rad/sec÷0.06 rad/sec) is 2 or less.

4. The ink follower for a water-based ink ballpoint pen as described in claim 1, wherein a ratio of tan δ of the ink follower at 600 rad/sec and 0.06 rad/sec (600 rad/sec÷0.06 rad/sec) is 2 or less.

5. The ink follower for a water-based ink ballpoint pen as described in claim 1, comprising a base oil comprising a non-water-soluble organic solvent having a viscosity of 5 Pas·sec or less at a temperature of 25° C. and a shearing speed of 1 to 400 $sec^{-1}$.

6. The ink follower for a water-based ink ballpoint pen as described in claim 5, wherein the base oil is polybutene having a number average molecular weight of 600 or more.

7. The ink follower for a water-based ink ballpoint pen as described in claim 5, wherein the base oil is a mineral oil.

8. The ink follower for a water-based ink ballpoint pen as described in claim 5, wherein the base oil is a silicone oil.

9. The ink follower for a water-based ink ballpoint pen as described in claim 1, further comprising a thickener.

10. The ink follower for a water-based ink ballpoint pen as described in claim 9, wherein the thickener is a calcium salt of phosphoric acid ester.

11. The ink follower for a water-based ink ballpoint pen as described in claim 9, wherein the thickener is fine particle silica.

12. The ink follower for a water-based ink ballpoint pen as described in claim 9, wherein the thickener is at least one selected from a block copolymer of polystyrene-polyethylene/butylene rubber-polystyrene and a block copolymer of polystyrene-polyethylene/propylene rubber-polystyrene.

13. The ink follower for a water-based ink ballpoint pen as described in claim 9, wherein the thickener is a hydrogenated styrene-butadiene rubber.

14. The ink follower for a water-based ink ballpoint pen as described in claim 9, wherein the thickener is at least one selected from a block copolymer of styrene-ethylene butylene-olefin crystal and a block copolymer of olefin crystal-ethylene butylene-olefin crystal.

15. The ink follower for a water-based ink ballpoint pen as described in claim 9, wherein the thickener is acetoalkoxyaluminum dialkylate.

* * * * *